US010227227B2

(12) United States Patent
Peterson et al.

(10) Patent No.: US 10,227,227 B2
(45) Date of Patent: Mar. 12, 2019

(54) LINER FOR A VESSEL

(71) Applicant: Plascon Group, Traverse City, MI (US)

(72) Inventors: David E. Peterson, Traverse City, MI (US); Matthew P. Klein, Suttons Bay, MI (US)

(73) Assignee: Plascon Group, Traverse City, MI (US)

( * ) Notice: Subject to any disclaimer, the term of this patent is extended or adjusted under 35 U.S.C. 154(b) by 487 days.

(21) Appl. No.: 14/533,658

(22) Filed: Nov. 5, 2014

(65) Prior Publication Data

US 2015/0122844 A1 May 7, 2015

Related U.S. Application Data

(60) Provisional application No. 61/900,102, filed on Nov. 5, 2013.

(51) Int. Cl.
*B67D 3/00* (2006.01)
*B67D 1/08* (2006.01)

(52) U.S. Cl.
CPC ..... *B67D 3/0067* (2013.01); *B67D 1/0807* (2013.01); *B67D 3/0083* (2013.01); *B67D 2001/0827* (2013.01); *B67D 2210/00062* (2013.01); *Y10T 29/49826* (2015.01)

(58) Field of Classification Search
CPC ..... B67D 3/0067; B67D 3/0083; B67D 2210/00062
USPC ..... 222/185.1
See application file for complete search history.

(56) References Cited

U.S. PATENT DOCUMENTS

| | | | | |
|---|---|---|---|---|
| 172,929 | A | 2/1876 | Newton | |
| 261,354 | A | 7/1882 | Johnson | |
| 2,377,261 | A | 5/1945 | Norris | |
| 2,549,207 | A | 4/1951 | Kestenbaum | |
| 2,601,319 | A | 6/1952 | Norris et al. | |
| 2,681,747 | A | 6/1954 | Norris et al. | |
| 2,718,985 | A | 9/1955 | Tamminga | |
| 2,815,887 | A | 12/1957 | Ford et al. | |
| 2,831,610 | A | 4/1958 | Dennie | |
| 2,861,718 | A * | 11/1958 | Winzen | B65D 75/5816 222/105 |
| 2,905,560 | A | 9/1959 | Bender et al. | |
| 3,081,911 | A | 3/1963 | Scholle | |

(Continued)

FOREIGN PATENT DOCUMENTS

| | | |
|---|---|---|
| AU | 199701838182 | 8/1997 |
| EP | 0084699 A1 | 8/1983 |

(Continued)

OTHER PUBLICATIONS

International Search Report PCT/IB2014/065832 dated Feb. 16, 2015.

*Primary Examiner* — Patrick M Buechner
*Assistant Examiner* — Michael J Melaragno
(74) *Attorney, Agent, or Firm* — Fishman Stewart PLLC

(57) ABSTRACT

A beverage containment assembly may include a disposable liner assembly for dispensing fluids with a vessel. The liner assembly may comprise a flexible liner configured for the vessel, a flexible tube; and a cuff having an interlock surface. The cuff may be received in at least a portion of the tube thereby securing the liner and the tube. The interlock surface may be configured to provide a seal between at least the cuff and the liner. A method of manufacturing same is further provided.

20 Claims, 10 Drawing Sheets

(56) References Cited

U.S. PATENT DOCUMENTS 3,087,655 A 4/1963 Scholle
3,089,622 A 5/1963 Westlake
3,094,154 A 6/1963 Daniels
3,096,912 A 7/1963 Rivette
3,112,047 A * 11/1963 Weinreich ..... B65D 77/065 222/105
3,123,254 A 3/1964 Rabby et al.
3,137,415 A 6/1964 Faunce
3,138,293 A 6/1964 Roak et al.
3,173,579 A 3/1965 Currie et al.
3,178,063 A 4/1965 Cox
3,212,681 A * 10/1965 Weikert ..... B65D 25/38 222/153.08
3,239,104 A * 3/1966 Scholle ..... B67B 7/26 222/514
3,255,923 A * 6/1966 Soto ..... A61J 1/10 206/223
3,325,058 A 6/1967 West, Jr.
3,606,396 A * 9/1971 Prosdocimo ..... F16L 33/222 285/148.16
3,792,799 A * 2/1974 Henfrey ..... B65D 75/5877 222/1
3,837,533 A * 9/1974 Splan ..... B65D 35/14 222/105
3,868,130 A * 2/1975 Schwertner ..... F16L 33/225 285/243
3,920,163 A 11/1975 Brown
3,945,534 A 3/1976 Ady
3,949,744 A 4/1976 Clarke
3,976,277 A 8/1976 Basel et al.
4,044,989 A 8/1977 Basel et al.
4,076,147 A * 2/1978 Schmit ..... B31B 7/00 222/105
4,334,640 A 6/1982 van Overbruggen et al.
4,375,864 A 3/1983 Savage
4,445,539 A 5/1984 Credle
4,475,670 A 10/1984 Rutter
4,513,885 A 4/1985 Hogan
4,516,691 A 5/1985 Christine et al.
4,516,693 A 5/1985 Gaston
4,516,692 A 6/1985 Croley
4,528,161 A 7/1985 Eckert
4,562,940 A * 1/1986 Asphar ..... B67B 7/28 222/88
4,606,476 A 8/1986 Pocock et al.
4,722,458 A 2/1988 Van Dal
4,776,488 A * 10/1988 Gurzan ..... B65D 75/5872 222/107
4,817,811 A 4/1989 Pfeiffer et al.
4,898,303 A 2/1990 Large et al.
4,911,399 A 3/1990 Green
4,919,306 A 4/1990 Heaps, Jr. et al.
4,925,216 A * 5/1990 Steer ..... A61J 1/10 285/200
4,943,001 A 7/1990 Meyer
4,948,014 A 8/1990 Rutter et al.
4,990,206 A 2/1991 Garske et al.
5,064,096 A 11/1991 Illing et al.
5,141,133 A * 8/1992 Ninomiya ..... B65D 5/748 222/541.2
5,188,259 A 2/1993 Petit
5,249,716 A 10/1993 O'Sullivan
5,272,236 A 12/1993 Lai et al.
5,334,180 A 8/1994 Adolf et al.
5,375,741 A 12/1994 Harris
5,407,099 A * 4/1995 Heuke ..... B67B 7/26 222/83
5,516,693 A 5/1996 Vaeck et al.
5,549,673 A 8/1996 Beale
5,551,602 A 9/1996 Kurtzahn et al.
5,639,015 A 6/1997 Petriekis et al.
5,647,511 A 7/1997 Bond
5,680,959 A 10/1997 Ettore et al.
5,697,410 A 12/1997 Rutter et al.
5,701,650 A * 12/1997 LaFleur ..... B29C 65/00 29/235
5,732,854 A 3/1998 Ruben et al.
5,797,524 A 8/1998 Lentz
5,884,648 A 3/1999 Savage
5,901,761 A 5/1999 Rutter et al.
5,947,603 A 9/1999 Tilman
5,983,964 A 11/1999 Zielinksi et al.
6,053,360 A 4/2000 Rutter
6,062,413 A 5/2000 Redmond
6,073,807 A 6/2000 Wilford et al.
6,082,584 A * 7/2000 Stern ..... B65D 75/5877 222/107
6,098,845 A * 8/2000 Stern ..... B65D 75/5877 222/83
6,116,467 A 9/2000 Petriekis et al.
6,131,767 A 10/2000 Savage et al.
6,138,878 A 10/2000 Savage et al.
6,168,074 B1 1/2001 Petriekis et al.
6,200,300 B1 3/2001 Petriekis et al.
6,202,370 B1 3/2001 Miller et al.
6,305,844 B1 10/2001 Bois
6,315,849 B1 11/2001 Ross
6,378,730 B1 4/2002 Reddy et al.
6,398,073 B1 6/2002 Nicolle
6,460,732 B1 * 10/2002 Drennow ..... B65D 51/222 222/107
6,607,097 B2 8/2003 Savage et al.
6,608,636 B1 8/2003 Roseman
6,609,636 B1 8/2003 Petriekis et al.
6,679,304 B1 * 1/2004 Vacca ..... B65D 75/5883 141/18
6,883,683 B1 4/2005 Cunningham et al.
6,996,879 B1 2/2006 Savicki
7,090,257 B2 * 8/2006 Werth ..... F16L 33/225 285/243
7,275,662 B1 * 10/2007 Milcetich ..... B67D 3/0083 211/74
7,316,329 B2 1/2008 Wertenberger
7,334,702 B2 2/2008 Cunningham et al.
7,452,317 B2 11/2008 Graham et al.
7,496,992 B2 3/2009 Ausnit
7,543,723 B2 6/2009 Wilford et al.
7,574,782 B2 8/2009 Ackerman
7,607,555 B2 10/2009 Smith
7,641,170 B2 1/2010 Spray et al.
7,721,755 B2 5/2010 Smith et al.
7,721,774 B2 5/2010 Cook et al.
7,721,921 B2 5/2010 Ramusch et al.
7,757,907 B2 7/2010 Smith et al.
7,922,212 B2 * 4/2011 Werth ..... A61M 39/12 285/242
7,922,213 B2 * 4/2011 Werth ..... F16L 33/2071 285/242
7,980,424 B2 7/2011 Johnson
8,006,874 B2 8/2011 Smith et al.
8,052,012 B2 11/2011 Kelly et al.
8,083,109 B2 12/2011 Smith et al.
8,091,864 B2 1/2012 Smith
8,113,239 B2 2/2012 Richards et al.
D676,320 S 2/2013 Richards et al.
8,397,958 B2 3/2013 Smith et al.
8,459,510 B2 6/2013 Richards et al.
8,459,511 B2 6/2013 Darby
8,752,734 B2 6/2014 Smith et al.
8,757,441 B2 6/2014 Smith et al.
9,090,443 B1 7/2015 Malinski
9,750,314 B2 9/2017 Ausnit et al.
2004/0099687 A1 5/2004 Magermans et al.
2004/0104246 A1 6/2004 Kawaguchi et al.
2005/0023292 A1 2/2005 Market et al.
2005/0269354 A1 12/2005 Smith
2006/0261088 A1 11/2006 Chin
2007/0006737 A1 1/2007 Hart
2007/0194045 A1 8/2007 Py et al.
2007/0205216 A1 9/2007 Smith
2007/0284389 A1 * 12/2007 Jacobs ..... B65D 9/04 222/1

(56) References Cited

U.S. PATENT DOCUMENTS

| | | | |
|---|---|---|---|
| 2008/0003337 | A1 | 1/2008 | Rasmussen et al. |
| 2008/0029540 | A1 | 2/2008 | Johnson |
| 2008/0245816 | A1 | 10/2008 | Armstrong et al. |
| 2008/0247681 | A1 | 10/2008 | Stolmeier |
| 2009/0127285 | A1 | 5/2009 | Hoare et al. |
| 2010/0072224 | A1 | 3/2010 | Ha |
| 2010/0200613 | A1 | 8/2010 | Smith et al. |
| 2010/0206900 | A1 | 8/2010 | Dobrusskin et al. |
| 2010/0296858 | A1 | 11/2010 | Richards et al. |
| 2011/0046585 | A1 | 2/2011 | Weston |
| 2011/0069911 | A1 | 3/2011 | Ackerman et al. |
| 2011/0103716 | A1 | 5/2011 | Reilly |
| 2011/0309279 | A1 | 12/2011 | Richards et al. |
| 2012/0027322 | A1 | 2/2012 | Ackerman |
| 2012/0223095 | A1 | 9/2012 | Smith |
| 2012/0234864 | A1 | 9/2012 | Liu |
| 2012/0305595 | A1 | 12/2012 | Braun et al. |
| 2012/0318821 | A1 | 12/2012 | Merner et al. |
| 2013/0028539 | A1 | 1/2013 | Vonwiller |
| 2013/0037568 | A1 | 2/2013 | Smith et al. |
| 2013/0038053 | A1 | 2/2013 | Imanishi et al. |
| 2013/0098947 | A1 | 4/2013 | Richards et al. |
| 2013/0126561 | A1 | 5/2013 | Smith et al. |
| 2013/0251868 | A1 | 9/2013 | Wells |
| 2013/0343678 | A1 | 12/2013 | Burggren |
| 2014/0119678 | A1 | 5/2014 | Ausnit et al. |
| 2015/0091295 | A1* | 4/2015 | Meyer ..... F16L 19/005 285/89 |
| 2015/0122844 | A1 | 5/2015 | Klein et al. |
| 2015/0359379 | A1 | 12/2015 | Peterson et al. |
| 2016/0272477 | A1 | 9/2016 | Bellmore et al. |

FOREIGN PATENT DOCUMENTS

| | | | |
|---|---|---|---|
| EP | 0777604 | A1 | 6/1997 |
| EP | 1147055 | A1 | 10/2001 |
| GB | 1416816 | A | 12/1975 |
| WO | WO-2008014605 | A1 | 2/2008 |
| WO | WO-2009019610 | A2 | 2/2009 |
| WO | WO-2010100435 | A1 | 9/2010 |
| WO | WO-2012073004 | A2 | 6/2012 |

* cited by examiner

LINER FOR A VESSEL

CROSS-REFERENCE TO RELATED APPLICATIONS

This application is based on and claims priority to U.S. Provisional Patent Application No. 61/900,102, filed Nov. 5, 2013, which is hereby incorporated by reference in its entirety.

FIELD OF TECHNOLOGY

A fluid dispensing assembly, and more particular, a flexible, disposable, and tamper-resistant liner assembly for dispensing fluids with a vessel, and methods of manufacturing and assembling the same.

BACKGROUND

A containment assembly such as urns or vessels may be used for holding and serving liquid or beverages. Typical assemblies may be constructed of metal and thus require cleaning after usage. In a restaurant environment, it is generally preferred to clean such vessels at the end of each shift so as to maintain cleanliness. However such a cleaning task requires increased man power and other resources and such is not preferred.

Another containment assembly uses a plastic bag assembly that is positioned within a containment vessel having a dispensing valve, which in turn is used to deliver beverages to consumers. These bag assemblies may be formed of a two-layer plastic sheet that is heat sealed on three sides with a spout that is heat sealed to an outer surface and over an aperture in one side of the plastic sheet. To fluidly connect with the dispensing value, the typical spout is releasably received into a filament connected to an elongated dispensing tube. As a result, the traditional spout may be physically separated from the elongated dispensing tube by the filament. To dispense beverages, the elongated dispensing tube is passed into the dispensing valve of the containment vessel to be selectively operated by customers. Thus, typical plastic bag assemblies may include excess components thereby unnecessarily increasing material costs and complexity of installation.

Further, typical bag assemblies are not tamper-resistant. After beverages have been dispensed or at the end of a work shift, the containment assembly should be cleaned by throwing away the plastic bag assembly. However, traditional bag assemblies include a releasable connection between the spout and filament. This releasable connection may be utilized to reuse portions or all of the bag assembly, which may lead to unsanitary conditions. As a result, there is a need for a tamper-resistant liner assembly.

Moreover, typical bag assemblies made of two-layer plastic sheet are not configured for the shape of the containment vessel. The concern with such designs is that the plastic bag does not uniformly fit within the containment vessel and as such, crevices are created at the base and elsewhere in the bag which tends to trap useful beverages that in turn cannot be released to the consumer for consumption. Thus, beverage product is wasted and such is not very efficient in the restaurant industry.

Other containment assembly designs employ expensive plastic bags that employ complex valves and dispensing systems that in turn may be used with a vessel. It would be helpful to provide an improved disposable container assembly that has improved functionality, a reduction in the number of working components, yet is more cost competitive for the beverage industry.

BRIEF DESCRIPTION OF THE DRAWINGS

While the claims are not limited to a specific illustration, an appreciation of the various aspects is best gained through a discussion of various examples thereof. Referring now to the drawings, exemplary illustrations are shown in detail. Although the drawings represent the illustrations, the drawings are not necessarily to scale and certain features may be exaggerated to better illustrate and explain an innovative aspect of an example. Further, the exemplary illustrations described herein are not intended to be exhaustive or otherwise limiting or restricted to the precise form and configuration shown in the drawings and disclosed in the following detailed description. Exemplary illustrations are described in detail by referring to the drawings as follows:

DETAILED DESCRIPTION

The exemplary assembly may include a rigid vessel such as an urn, a liner such as a flexible fitted liner, a cuff such as a friction cuff configured to be positionable on an inner wall of the liner, a tube such as a flexible tube positionable on an outer wall of the liner, and a spigot that allows for the flexible tubing to be inserted therethrough. The vessel may further include a flow operator that pinches the tube to allow controlled dispensing.

The assembly may be configured to allow for sanitary dispensing of beverages for human consumption. The assembly may be configured such that the beverage may bypass the urn or the spigot for easy cleaning. Instead, the assembly may be configured such that the liquid is handled by the liner, cuff, and tube thereby minimizing or preventing contact between the liquid from the vessel.

Figure 1:
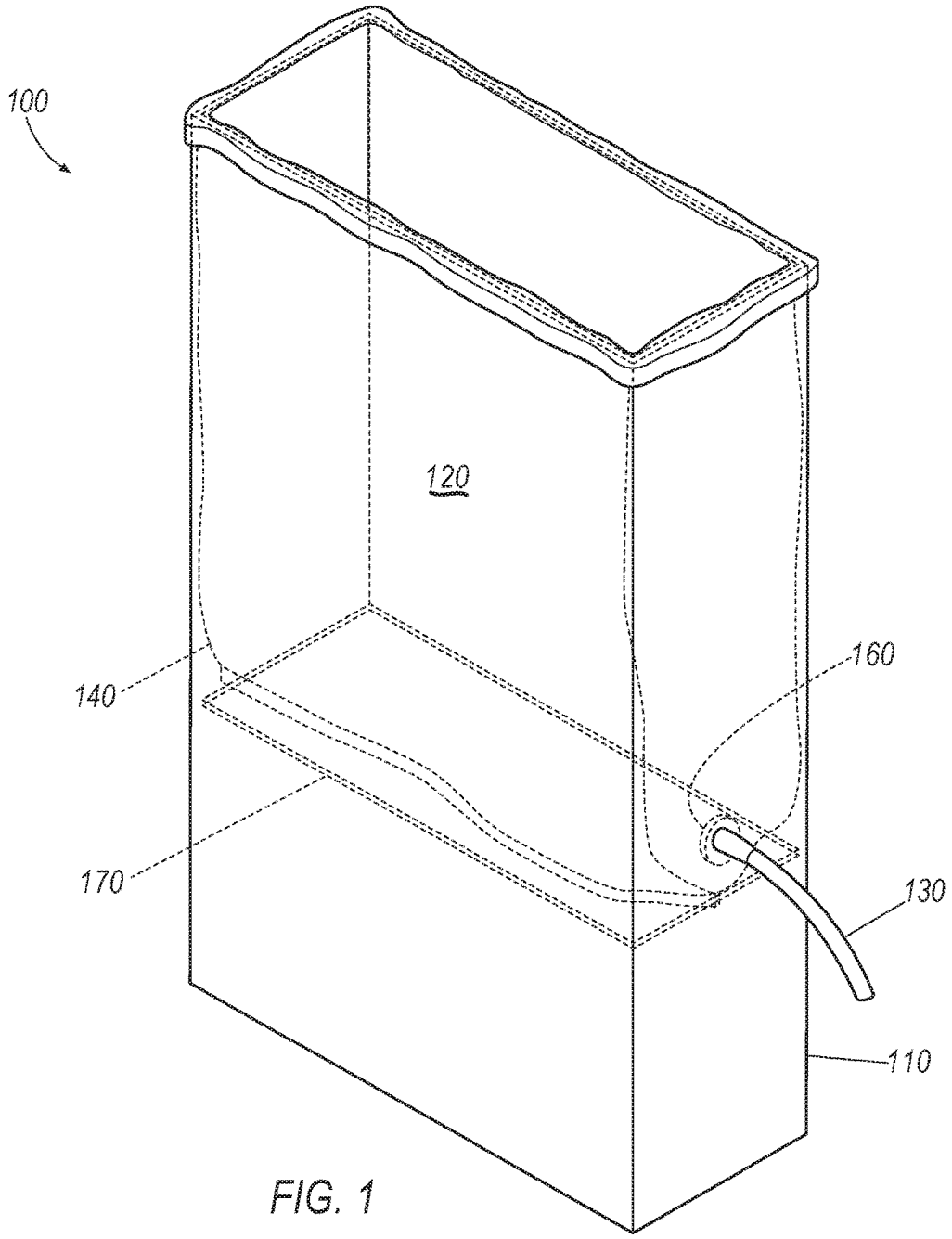
FIG. 1 illustrates a perspective view of an improved containment assembly.
Figure 2:
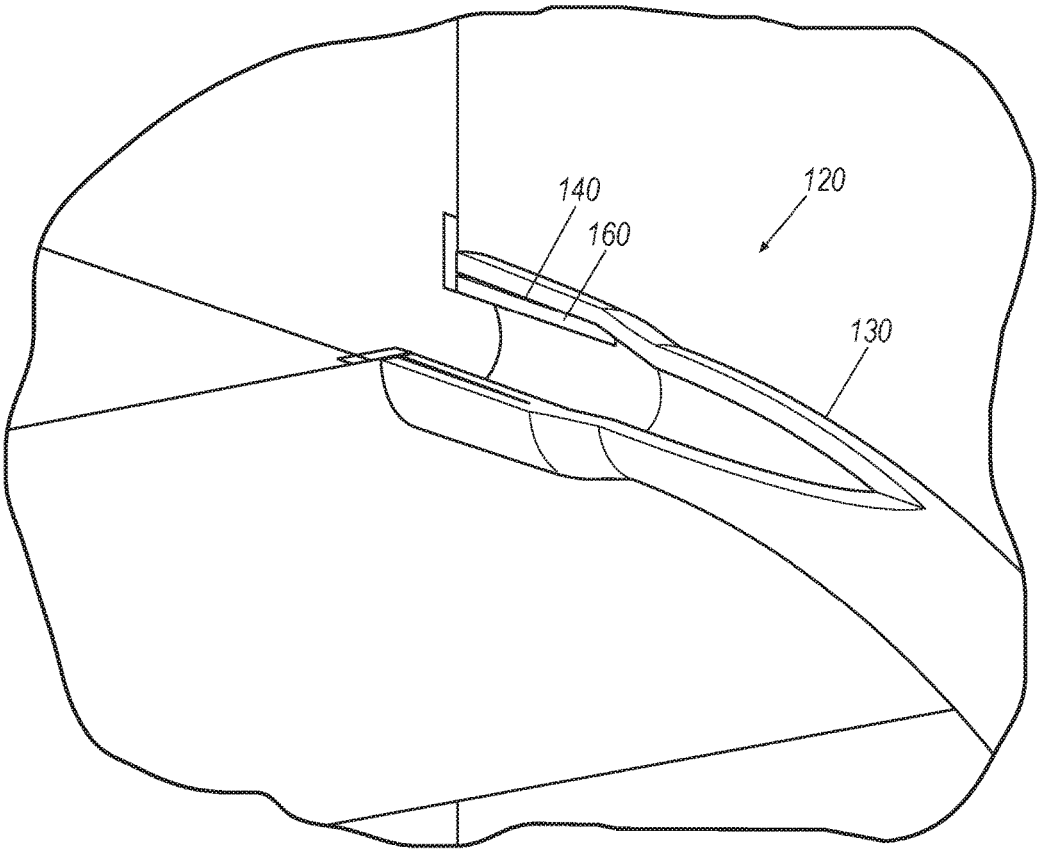
FIG. 2 illustrates an enlarged perspective view of the FIG. 1, for example, including a liner assembly having with a tube, a liner, and a cuff with a flange.

With reference to FIGS. 1-2, a containment assembly 100 may include a vessel 110 and a liner assembly 120. The vessel 110 may include any liquid or beverage dispenser such as a beverage or tea urn. As shown in FIG. 2, the liner assembly 120 may include a tube 130, a liner 140 such as a flexible liner, and a cuff 160 such as a rigid cuff with or without a flange. The liner 140 may be specially dimensioned and configured to match an internal cavity of the vessel 110 and the liner 140 and vessel 110 may include a tapered bottom portion to facilitate flow of liquid therefrom, as discussed in more detail below.

The liner assembly 120 may be configured to provide a seal between the liner 140 and the tube 130, for example, using cuff 160. Cuff 160 may include a unitary or one piece component configured to secure the liner 140 and tube 130 together. The liner assembly 120, using the cuff 160, may utilize an interlock such as a friction interlock. The interlock may provide a permanent or tamper-resistant connection between any portions of liner assembly 120, for example, being destroyed in response to disassembly. For example, the liner 140 and the tube 130 may be connected with the interlock. To provide this seal, the cuff 160, such as a circular spacer with or without a flange, may be positioned inside the tube 130 thereby outwardly expanding a diameter of an inner surface of the tube 130. The liner 140 may be positioned between the tube 130 and the cuff 160. Thus, the cuff 160 may outwardly push the liner 140 against an inside surface of the tube 130 thereby providing a seal such as a liquid tight seal. As a result, the cuff 160 provides a unitary or one piece component that secures the liner 140 relative to the tube 130 thereby eliminating unnecessary components. Accordingly, the interlock may provide a fluid tight structure or seal thereby reducing leakage of liquid along the liner assembly 120 and may provide a permanent or tamper-resistant connection between the cuff 160, liner 140, and tube 130 that may not be removed without at least partially destroying at least a portion of the liner 140.

Figure 3:
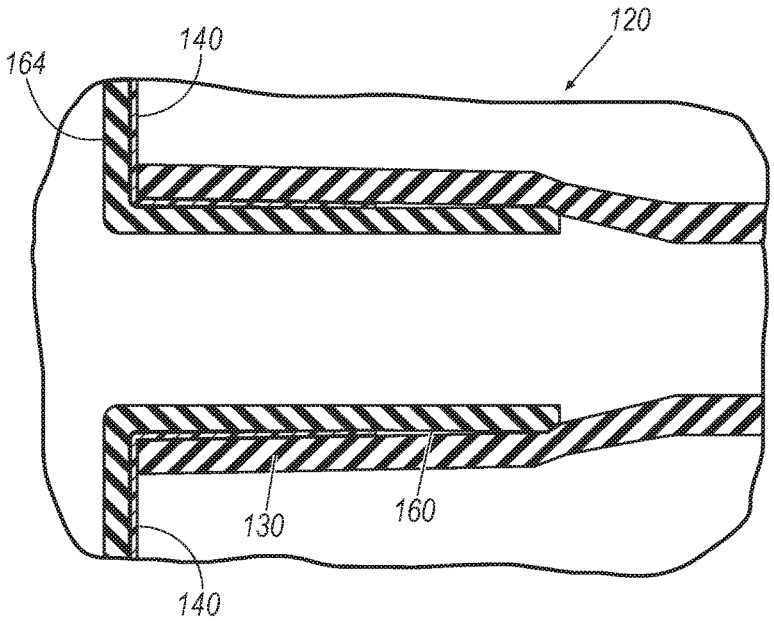
FIG. 3 illustrates an enlarged side view of FIG. 2, for example, showing the liner assembly of FIG. 2.
Figure 5:
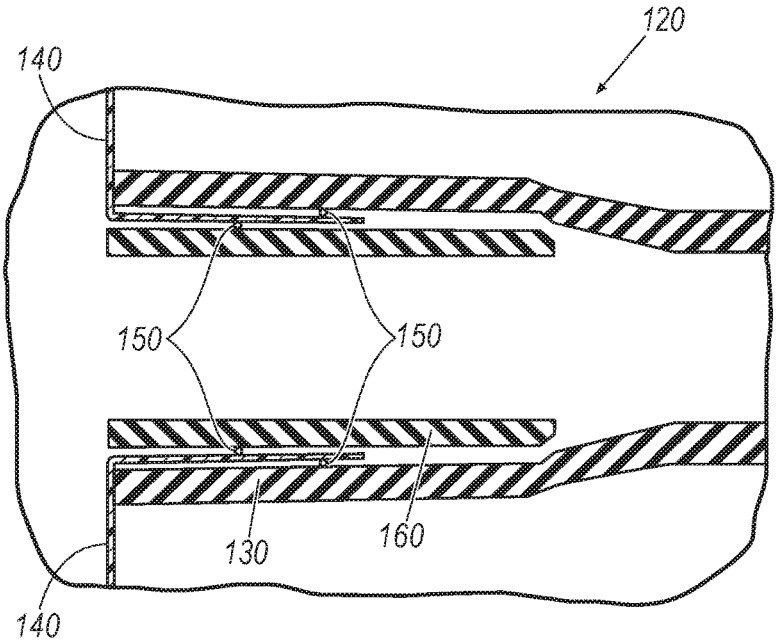
FIG. 5 illustrates an enlarged side view of another liner assembly having a tube, a liner, and a cuff, for example, without a flange.

Referring to FIGS. 3 and 5, the liner assembly 120 may include the liner 140 interposed between the tube 130 and the cuff 160. The cuff 160 may include an inner surface having a passage for receipt of liquid from the liner 140 and an outer surface that is dimensioned and configured to be received in and outwardly stretch an inner surface of the tube 130. The cuff 160 may be configured to be positioned with an axial force along the tube 130 and may be configured to expand the tube 130 thereby placing an outward force against the liner 140 and toward the inner surface of tube 130. In reaction, the tube 130 may place an inward force against the liner 140 and toward the outer surface of the cuff 160. Thus, the liner assembly 120 may be cold-formed with the axial force, outward force, inward force, or a combination thereof, thereby creating an interlock between the tube 130, liner 140, and cuff 160. Accordingly, the liner 140 may be held between the tube 130 and the cuff 160 thereby providing a permanent or tamper-resistant connection between the cuff 160, liner 140, and tube 130 that may not be removed without at least partially destroying at least a portion of the liner 140.

The liner assembly 120 may be configured for a permanent or tamper-resistant connection between tube 130, liner 140, and cuff 160, for example, being at least partially destroyed in response to disassembly. For example, the liner assembly 120 (e.g., liner 140 and/or tube 130) may be configured to at least partially destruct, rip or tear in the event of disassembly thereby providing a permanent or tamper-resistant liner assembly 120 in response to disassembly. Alternatively, the tube 130, liner 140, and cuff 160 may be connected using an adhesive or heat seal thereby providing a permanent or tamper-resistant liner assembly 120, for example, being at least partially destroyed in response to disassembly. In addition, liner assembly 120 may utilize any other destructive interlock between the tube 130, liner 140, and cuff 160 that results in at least partial destruction of at least one of the tube 130, liner 140, and cuff 160 during disassembly. Thus, the liner assembly 120 may be configured to provide a permanent or tamper-resistant connection, for example, being at least partially destroyed in response to disassembly.

Figure 4:
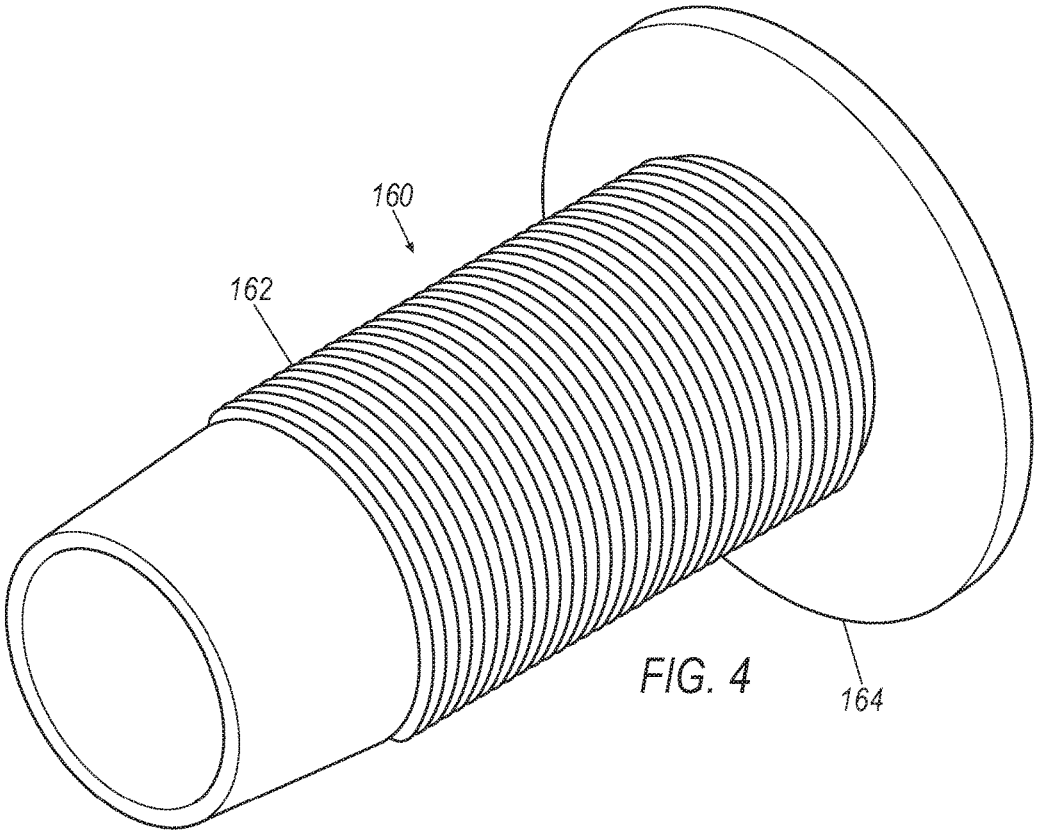
FIG. 4 illustrates an enlarged perspective view of a friction cuff, for example, with a flange.
Figure 6:
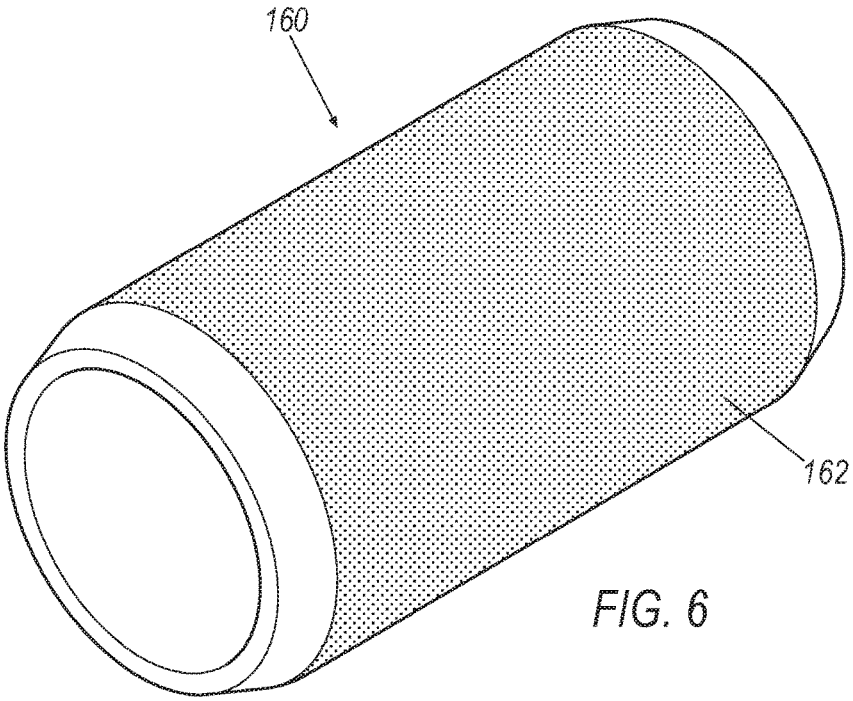
FIG. 6 illustrates an enlarged perspective view of another cuff, for example, without a flange.

The liner assembly 120 may include the cuff 160 with a flange 164 as shown in FIG. 4 or without a flange 164 as shown in FIG. 6. The cuff 160 may include a rigid cuff, for example, configured to resist bending of the flange 164 and maintain a passage therethrough. Further, the flange 164 may be configured to maintain the liner 140 in an outward position relative to the tube 130, for example, to resist blockage of the passage of the cuff 160. To maintain the outward position, the flange 164 may be configured to releasably contact or push against the liner 140 or may be adhered or heat sealed thereto. Alternatively, the cuff 160 may be without a flange 164, for example, to allow relative inward movement of the liner 140.

As mentioned above, the liner 140 may be affixed (e.g., permanently) relative to the cuff 160 and tube 130. As shown in FIG. 5, the liner assembly 120 may include an optional adhesive 150 (e.g., a food grade adhesive) thereby permanently adhering the tube 130, liner 140, and cuff 160 together. Alternatively, the liner 140 may be affixed relative to the cuff 160 and tube 130 using a heat seal thereby permanently fusing the tube 130, liner 140, and cuff 160 together.

As shown in FIGS. 4 and 6, the cuff 160 may include an interlock surface 162. The interlock surface 162 may be configured to provide or facilitate the interlock between the cuff 160, liner 140, and tube 130. The interlock surface 162 may include a plurality of protrusions interposed by a plurality of recesses, thereby resulting in an increased surface area and a higher coefficient of friction. For example, this may create a plurality of ridges with alternating valleys as shown in FIG. 4. As another example, the interlock surface 162 may include a plurality of pores as shown in FIG. 6. Alternatively, the interlock surface 162 may be smooth. Thus, the interlock surface 162 may facilitate the interlock and resulting seal between the cuff 160, liner 140, and tube 130.

Figure 7:
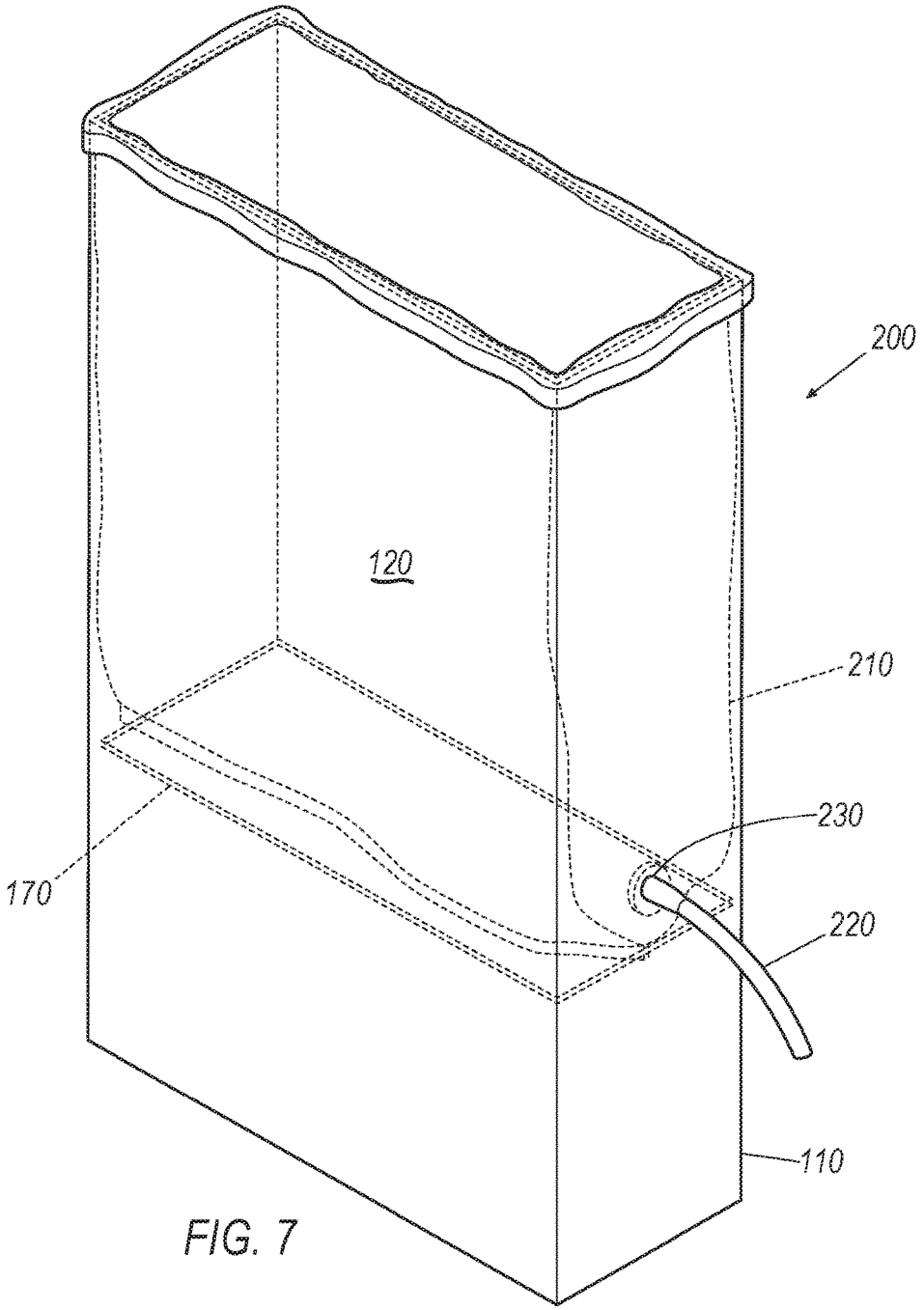
FIG. 7 illustrates a perspective view of a containment assembly having an alternative liner assembly.
Figure 8:
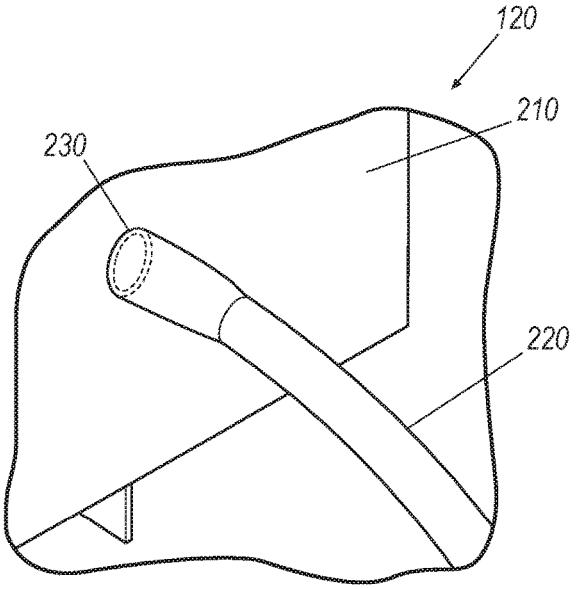
FIG. 8 illustrates an enlarged perspective view of the liner assembly of FIG. 7.
Figure 9:
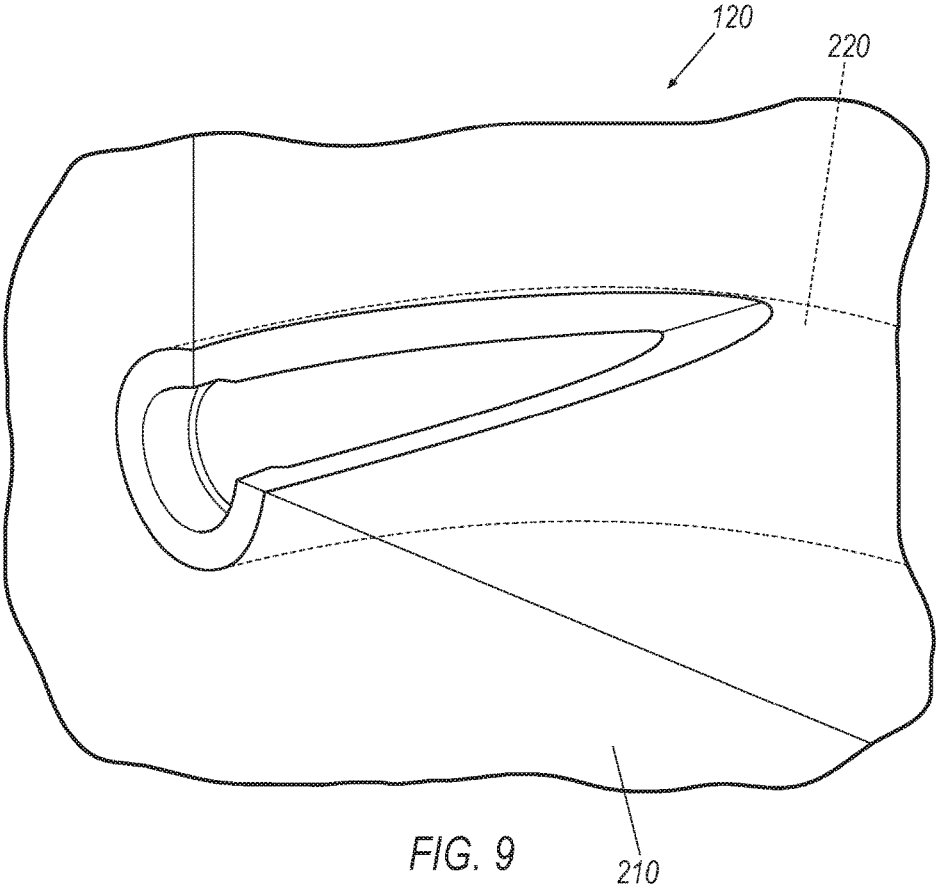
FIG. 9 illustrates another enlarged perspective view of the liner assembly of FIG. 7.
Figure 10:
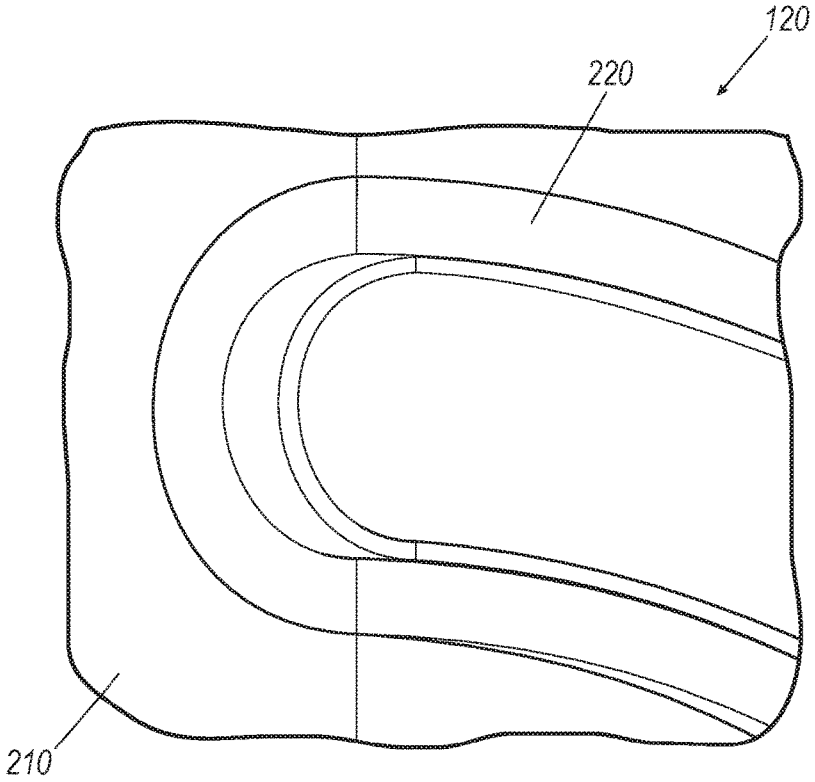
FIG. 10 illustrates another enlarged perspective view of the liner assembly of FIG. 7.

Referring to FIG. 7, the dimensions of the liner 140 are configured to allow for a minimum amount of liner material to be used for the specific vessel 110 that is being lined. This reduces the number of folds created when the liner is installed into the vessel and filled, thus improving drainage of the liquid product. The liner 140 may be constructed from a tube of flexible material having one end sealed closed. The tube 130 is attached to the liner 140, which may occur proximal to the sealed end of the liner 140 at a point configured to assist in draining the beverage product in its entirety from the liner 140. Further, the liner 140 may be dimensioned and configured to provide an optimum size to reduce material usage and improve draining with respect to the vessel 110. In addition, the liner 140 may be optimized or dimensioned according to a vessel length, a vessel height, a vessel opening perimeter or circumference, and a spigot location relative to a length and a width of the vessel 110.

The liner 140 may be made from flat tubing, gusseted tubing, or a flexible pouch having opposed sidewalls that may be optionally connected at peripheral edges. The liner 140 may be any shape configured to form-fit to the vessel 110. The liner 140 may be configure to be stretched over the top edge of the vessel 110, for example, to keep the liner 140 from sliding down inside of the vessel 110 upon being filled.

Methods of manufacturing the liner 140 are contemplated. Methods may include converting raw material into roll stock and converting the roll stock into individual liners 140. The raw material may be in the form of roll stock, for example, dimensioned according to a vessel length and a vessel width of the vessel 110. The roll stock may then be converted by cutting (e.g., using heat or a cutter) the liner 140 to an optimum liner length (e.g., a vessel height of vessel 110) thereby resulting in an end open at the top of the liner 140 and a bottom of the liner 140 that is sealed.

Figure 13:
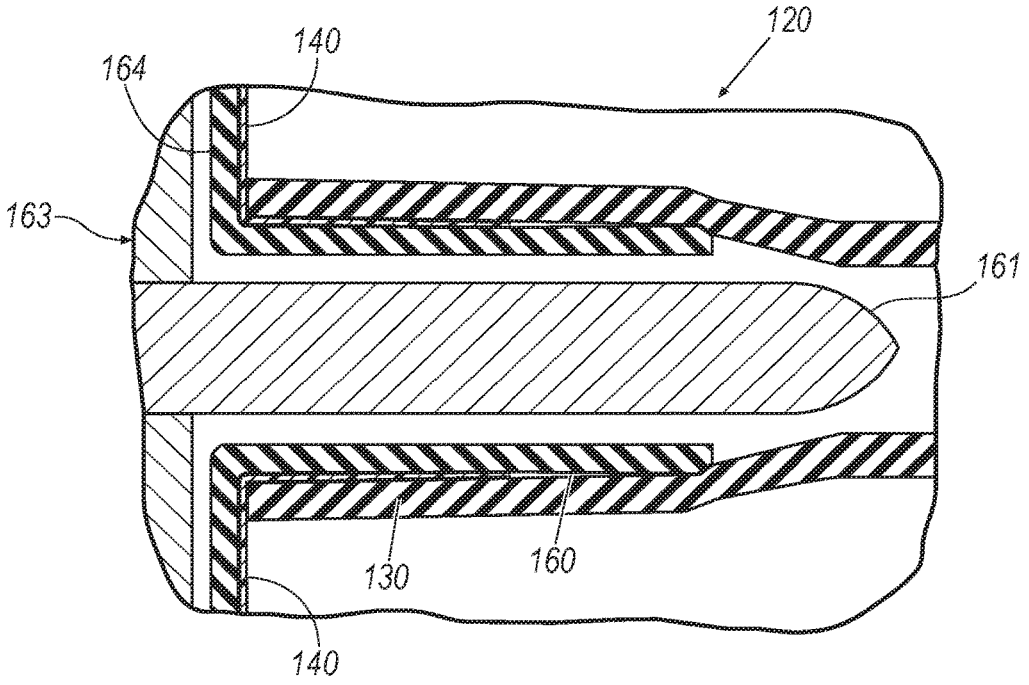
FIG. 13 illustrates a locating stud of an assembly tool or platform of the present disclosure.

Furthermore, methods of assembling the liner assembly 120 are contemplated. A method may include positioning the cuff 160 (e.g., a friction cuff) over a locating stud 161 of an assembly tool or platform 163 as shown in FIG. 13, positioning the liner 140 over at least a portion of the cuff 160 and locating stud, and pushing tubing 130 over at least a portion of the liner 140, cuff 160, and locating stud, thereby outwardly expanding the tube 130 and puncturing the liner 140. In use, puncturing the liner 140 allows fluid to flow from the liner 140 through the cuff 160, and into the tube 130. As such, the tube 130, liner 140, and cuff 160 may be held together (e.g., permanently) by an inward force from the elasticity of the tube 130 and a friction force between the tube 130, liner 140, and cuff 160. Alternatively or in addition, any or all of tube 130, liner 140, and cuff 160 may be held together (e.g., permanently) using an adhesive or a heat seal therebetween. Accordingly, the liner assembly 120 may be configured with layers having an order from inside to outside as follows: the cuff 160 (e.g., a friction cuff), the liner 140, and the tubing 130 (e.g., flexible tube). In addition, a method may further include removing the liner assembly 120 from the assembly tool or platform 163 and packing the liner assembly 120 for distribution.

Referring to FIGS. 7-10, an assembly 200 may include a vessel 110 and a liner assembly 120. The vessel 110 may include a support surface 170. The liner assembly 120 may include a liner 210 (e.g., a fitted flexible liner), a tube 220 (e.g., a flexible tubing), and a heat seal 230. The liner 210 may include a single piece heat sealed liner dimensioned and figured for the vessel 110. The liner 210 may be directly attached to a tube 220 with the heat seal 230. The heat seal 230 may provide a permanent or tamper-resistant connection, for example, being at least partially destroyed in response to disassembly. The heat seal 230 may be created by using a heat probe. The heated probe may push the liner 210 into an inner surface of the tube 220 thereby sealing an outer surface of the liner 210 at the point at which the liner 210 contacts the inner surface and end of the tube 220.

The liner 210 may be dimensioned and configured to allow for a minimum amount of liner material to be used for the specific vessel 110 being lined. This may reduce the number of folds created when the liner 210 is installed into the vessel 110 and filled, thus improving drainage of the liquid or product. The liner 210 may be constructed from a tube 220 of flexible material having one end sealed closed. The tube 220 and liner 210 may be permanently attached, which may occur proximal to the sealed end of the liner 210 at a point configured to assist in draining the product in its entirety from the liner 210. The liner 210 may then placed over a locating board with heat probe for sealing. The tube 220 may then be placed above the heat probe and a foot operated pedal may then pushes the heat probe through a hole in the locating board thereby forming the heat seal 230. Accordingly, the liner assembly 120 may include the layers from inside to outside as follows: liner 210, heat seal 230, and tube 220.

Figure 11:
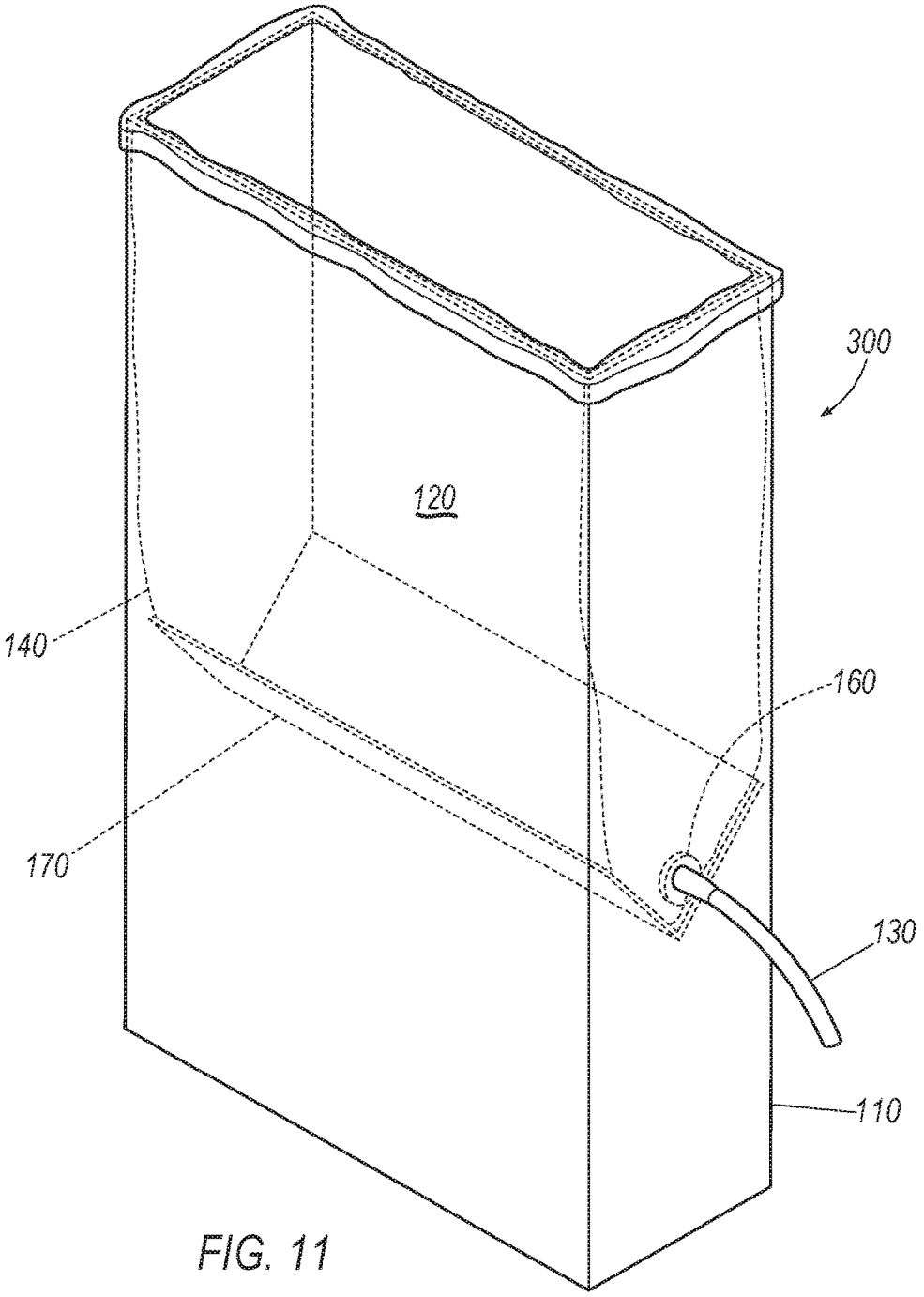
FIG. 11 illustrates a perspective view of an alternative containment assembly.
Figure 12:
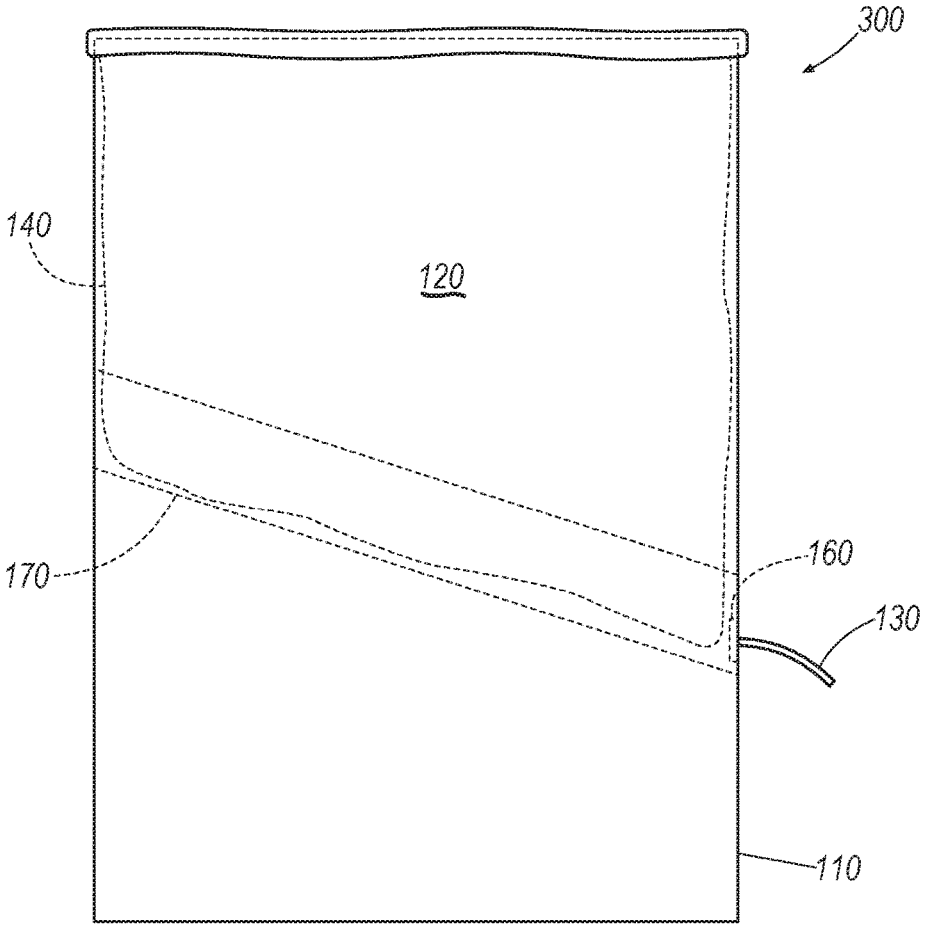
FIG. 12 illustrates a side view of an alternative containment assembly.

Referring to FIGS. 11 and 12, an assembly 300 may include the vessel 110 and the liner assembly 120 The liner 140, the vessel 110, or both the liner 140 and vessel 110 may be configured with a tapered structure, for example as a bottom of the liner 140 and/or the support surface 170 of the vessel 110. For example, the tapered structure may optimize utilization of fluid in the liner 140 by urging fluid toward the tube 130. The tapered structure may include any structure configured to urge liquid toward the tube 130 of the liner assembly 120 and/or spigot of the vessel 110. The tapered structure may include any number of tapered surfaces as part of the vessel 110 or liner 140 that are configured to angle or slope liquid toward the spigot of the vessel 110. The tapered structure may include two tapered surfaces forming a v-shape (e.g., along a lengthwise, central axis of the vessel 110) as shown in FIG. 11, may be tapered downwards from a first end (e.g., a backend) to a second end (e.g., a front end) of the vessel 110 as shown in FIG. 12, or may be a combination thereof. For example, the bottom of liner 140 or the support surface 170 of vessel 110 may include the tapered structure. Moreover, the liner 140 may have any number of gussets or may be heat sealed to form a tapered structure as shown in FIGS. 11 and 12. As such, the vessel 110 and liner 140 may be configured to taper fluid out of the liner 140 and toward the tube 130 thereby optimizing usage of the fluid.

It will be appreciated that the aforementioned method and devices may be modified to have some components and steps removed, or may have additional components and steps added, all of which are deemed to be within the spirit of the present disclosure. Even though the present disclosure has been described in detail with reference to specific embodiments, it will be appreciated that the various modifications and changes can be made to these embodiments without departing from the scope of the present disclosure as set forth in the claims. The specification and the drawings are to be regarded as an illustrative thought instead of merely restrictive thought.

What is claimed is:

1. A method of assembling a liner assembly comprising:
- positioning a cuff over a locating stud of an assembly tool, the cuff having an interlock surface and a flange;
- positioning a flexible liner over at least a portion of the cuff;
- pushing a tube over at least a portion of the liner and on to the cuff such that an end of the tube forces the liner against the flange of the cuff, thereby outwardly stretching at least a portion of tube and puncturing the liner;
- wherein the cuff is received in at least a portion of the tube, thereby securing the liner between the cuff and the tube.

2. The method of claim 1, wherein the cuff is configured to apply an outward force to the liner and the flexible tube is configured to apply an inward force to the liner.

3. The method of claim 1, wherein the interlock surface is configured to provide a permanent connection between the cuff, liner, and tube that is at least partially destroyed in response to disassembly.

4. The method of claim 1, wherein the cuff includes a flange configured to maintain the liner relative to the tube to resist blockage of a passage of the cuff.

5. The method of claim 1, wherein the interlock surface includes at least a smooth portion.

6. The method of claim 1, wherein the interlock surface includes a plurality of ridges to engage the inner surface of the liner.

7. A beverage containment assembly for a vessel, the assembly comprising:

a flexible liner having an inner surface and an outer surface;

a flexible tube; and a cuff having an elongated body and a flange, wherein the elongated body is received in at least a portion of the tube and the flange is positioned against the inner surface of the liner, and the elongated body comprises an interlock surface that is secured relative to the inner surface of the liner with a heat seal, thereby securing the liner between the cuff and the tube.

8. The assembly of claim 7, wherein the cuff is configured to apply an outward force to the liner and the flexible tube is configured to apply an inward force to the liner.

9. The assembly of claim 7, further comprising an interlock surface that is configured to provide a permanent connection between the cuff, liner, and tube that is at least partially destroyed in response to disassembly.

10. The assembly of claim 7, wherein the cuff includes a flange configured to maintain the liner relative to the tube to resist blockage of a passage of the cuff.

11. The assembly of claim 7, wherein the interlock surface includes a plurality of ridges to engage the inner surface of the liner.

12. The assembly of claim 7, wherein at least one of the vessel and the liner includes a tapered structure configured to urge fluid toward the tube.

13. A liner assembly comprising:

a cuff having an interlock surface and a flange;

a flexible liner positionable over at least a portion of the cuff, an inner surface of the liner being positioned against the flange; and a tube that is positionable over at least a portion of the liner and cuff thereby outwardly expanding at least a portion of tube, an end portion of the tube being positioned near an outer surface of the liner, wherein the cuff receives at least the end portion of the tube, and the interlock surface is secured relative to the inner surface of the liner with a heat seal, thereby sealing the liner between the cuff and the tube.

14. The assembly of claim 13, wherein the cuff is configured to apply an outward force to the liner and the flexible tube is configured to apply an inward force to the liner.

15. The assembly of claim 13, wherein the interlock surface is configured to provide a permanent connection between the cuff, liner, and tube that is at least partially destroyed in response to disassembly.

16. The assembly of claim 13, wherein the cuff includes a flange configured to maintain the liner relative to the tube to resist blockage of a passage of the cuff.

17. The assembly of claim 13, wherein the interlock surface includes at least a smooth portion.

18. The assembly of claim 13, wherein the interlock surface includes a plurality of ridges.

19. A liner assembly for a vessel, the assembly comprising:

a flexible liner positionable in the vessel, the liner having an inner surface and an outer surface; and a flexible tube with an end portion positioned against and heat sealed to an outer surface of the liner, thereby securing the tube directly to the outer surface of the liner.

20. The assembly of claim 19, further comprising a cuff in contact with the inner surface of the liner and located in at least a portion of the tube.

* * * * *